United States Patent [19]

Rendahl et al.

[11] Patent Number: 4,884,792

[45] Date of Patent: Dec. 5, 1989

[54] CLAMP

[75] Inventors: Roy Rendahl, Minnesota City; Edward L. Steele, Winona, both of Minn.

[73] Assignee: Lake Center Industries a division of Guy F. Atkinson Company, San Francisco, Calif.

[21] Appl. No.: 230,901

[22] Filed: Aug. 11, 1988

[51] Int. Cl.[4] ..... B25B 1/14

[52] U.S. Cl. ..... 269/236

[58] Field of Search ..... 2169/95, 229, 232, 333, 2169/235, 236, 248, 228

[56] References Cited

U.S. PATENT DOCUMENTS

| | | | |
|---|---|---|---|
| 781,356 | 1/1905 | Peelman . | |
| 2,271,041 | 1/1942 | Stuckert | 269/236 |
| 2,537,594 | 1/1951 | Lehmann . | |
| 2,627,210 | 2/1953 | Kear . | |
| 2,690,088 | 9/1954 | Wiglesworth . | |
| 2,815,052 | 12/1957 | Krasnow | 269/236 |
| 3,752,465 | 8/1973 | Siegmund . | |
| 4,046,363 | 9/1977 | Whitley | 269/236 |
| 4,475,726 | 10/1984 | Smith . | |
| 4,477,063 | 10/1984 | Mehier . | |
| 4,729,552 | 3/1988 | Pempek | 269/236 |

*Primary Examiner*—Robert C. Watson

*Attorney, Agent, or Firm*—Kinzer, Plyer, Dorn, McEachran & Jambor

[57] ABSTRACT

This invention is in the nature of a clamp to be used to clamp, for example, parts on a work piece for machining and the like. The clamp has a clamp bar and a handle bar and a roller and cam arrangement so that the clamp bar can be releasably held in an up-lock position by the cam but may be released and then the cam applied to clamp the clamp bar to the work piece.

7 Claims, 2 Drawing Sheets

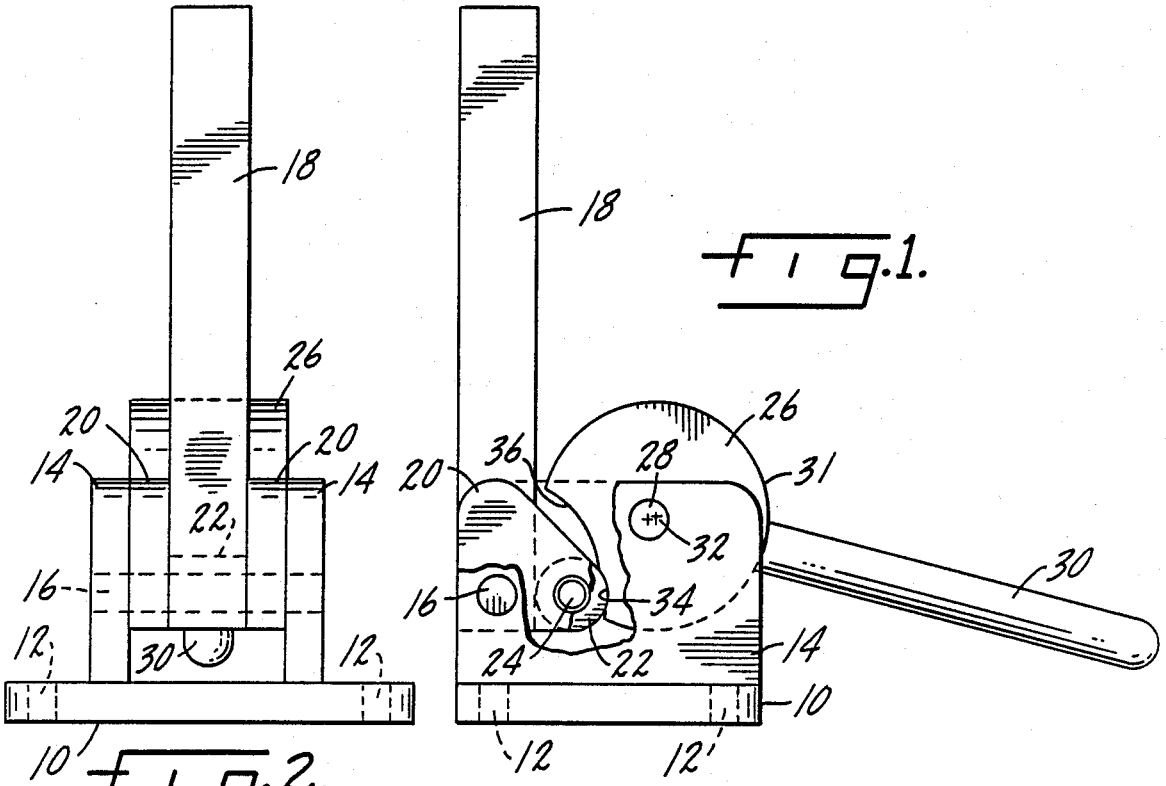
Fig. 1.
Fig. 2.
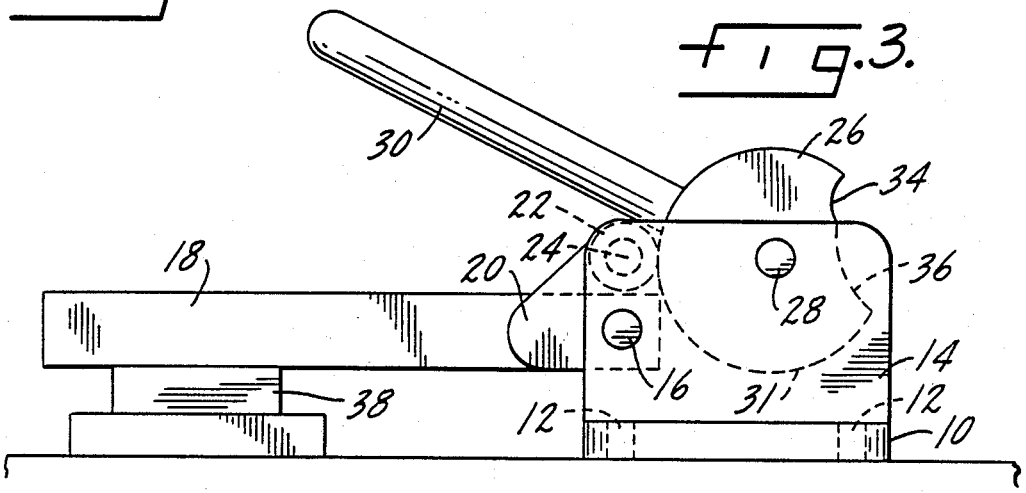
Fig. 3.
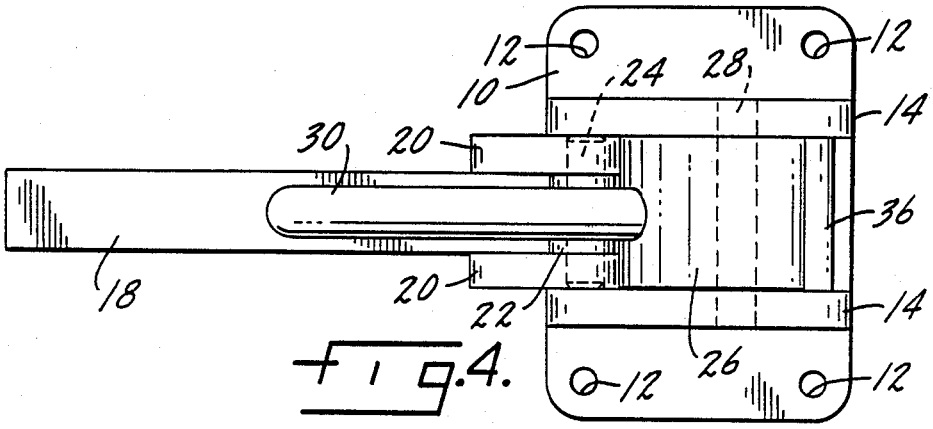
Fig. 4.

CLAMP

SUMMARY OF THE INVENTION

This invention is concerned with a clamp arrangement for holding work pieces in a fixed position for machining, drilling, or what-have-you.

A primary object of the invention is a clamp which has a self-adjusting clamping range.

Another object is a clamp of the above type that has an automatic up-lock position.

Another object is a clamp of the above type that will not loosen under vibration.

Another object is a clamp of the above type in which the clamping force applied at the clamping position is the maximum clamping force.

Another object is a clamp of the above type that will clamp parts of varying thicknesses.

Another object is a clamping device of the above type that will hold parts in position without adjustment to the clamping device.

Other objects will appear from time to time in the ensuing specification and drawings.

BRIEF DESCRIPTION OF THE DRAWINGS

FIG. 1 is a side view of the clamp;

FIG. 2 is a front view of the clamp;

FIG. 3 is a side view, similar to FIG. 1, of a different operative position;

FIG. 4 is a top view of FIG. 3;

BRIEF DESCRIPTION OF THE PREFERRED EMBODIMENT

Figure 6:
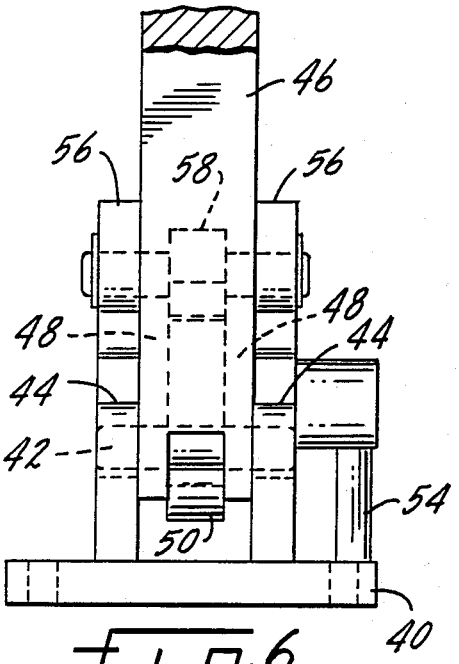
FIG. 6 is a front view of the clamp of FIG. 5.

The device as shown in the drawings with a conventional base plate 10 with suitable openings 12 on the extensions or flanges thereof so that the device may be held in position by bolts, screws, or the like. Spaced uprights 14 are mounted on the upper surface of the base plate by welding or screws with a pivot 16 between them for a clamp bar 18. Offsets 20 are mounted on each side of the clamp bar and are suitably connected thereto so that they pivot with the clamp bar about pivot 16 as a unitary structure. A roller 22 is freely pivoted as at 24 to one side of the clamp bar.

A cam 26 is pivoted at 28 between the uprights with a handle 30. The cam may be assumed to pivot about point 28 while the face 31 of the cam may be swung on an arc about a point 32 slightly eccentric to point 28.

The cam face has two cut outs or reliefs, the first at 34 which is somewhat smaller and the second at 36 which is somewhat larger. In the FIG. 1 position it will be noted that when the clamp bar 18 is in its upright or release position and the cam handle 30 has been moved down, the face of the roller 22 will engage and fit in the smaller recess 34 in the cam face. This is to say that the recess 34 may be swung on an arc that generally matches the exterior of the roller 22.

When the cam handle 30 has been raised from the FIG. 1 position up to approximately the horizontal, say about 15°, the relief 34 in the face of the cam will be moved away from the roller 22 thus releasing it. The clamp bar 18 then may be rotated counterclockwise in FIG. 1 about 90° until it is in a horizontal position as shown in FIG. 3 where it may contact any suitable work piece 38. The release or cut out 36 is such that when the clamp bar 18 is moved from its vertical to its horizontal clamping position, from FIG. 1 to FIG. 3, the roller 22 will move through the cut out 36 and will clear its surface. Once the clamp bar is in its clamping position, as in FIG. 3, the cam handle 30 can be rotated counterclockwise all the way to its full locking position as shown in FIG. 3 which is a movement on the order of, say, 180°, depending upon the profile of the cam surface 31. The relationship and dimensions are such that the cam surface 31 contacts the roller 22 during rotation of the cam handle 30 and fully tightens against it, for example as shown in the FIG. 3 position. As the cam is rotated through, say, 180° of travel by the cam handle 30, the pressure against the roller 22 increases which causes the clamping action between the clamp bar 18 and the work piece.

Unlike the typical over-center toggle-locking clamp in which the maximum clamping force needed to obtain locking position is greater than the final clamping force, the force of the present clamp is the maximum clamping force.

While the handle 30 for the cam has been shown as socketed directly into the cam face, it could be mounted on the outside of the base 10 on the pivot or shaft 28 to rotate the cam. And if such an external handle is used, provision should probably be made so the cam 26 would not rotate over its center high point. Also, it is conventional to clamp a screw adjustment pad to the face of the clamp bar 18 and one could be used with this clamp if desired.

In the variant form shown in FIGS. 5 through 8, the clamp has a base 40 with a pivot 42 on uprights 44 for a clamp bar 46 which has extensions 48. A cam 50 is mounted between the extensions 48 on a pivot 52 which has a cam handle 54 on one end or the other. Uprights 56 are provided on the base in spaced relation to the pivot 42 with a roller 58 thereon positioned a suitable distance above the base. The cam surface 60 may be assumed to swing on a radius somewhat eccentric to the axis of pivot 52 and may also have a detent or cut out 62 and a release or clearance 64, similar to the cam surface in the FIGS. 1 through 4 form.

Figure 5:
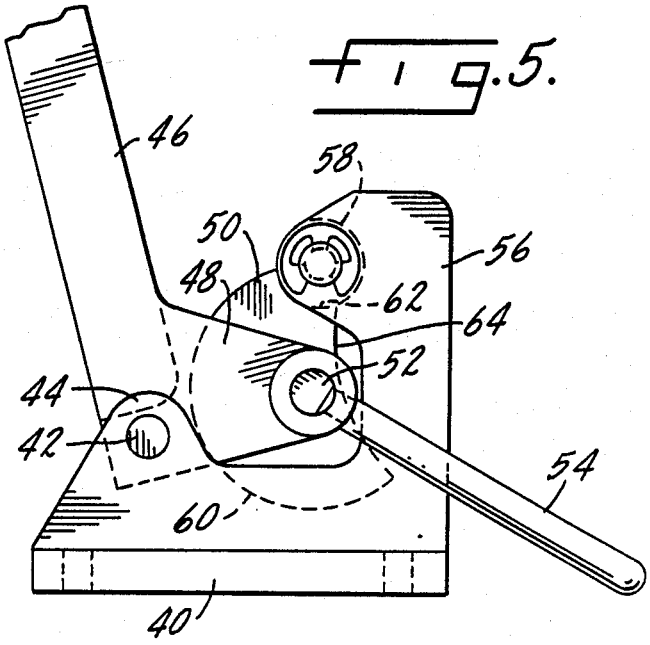
FIG. 5 is a side view of a variant form.
Figure 7:
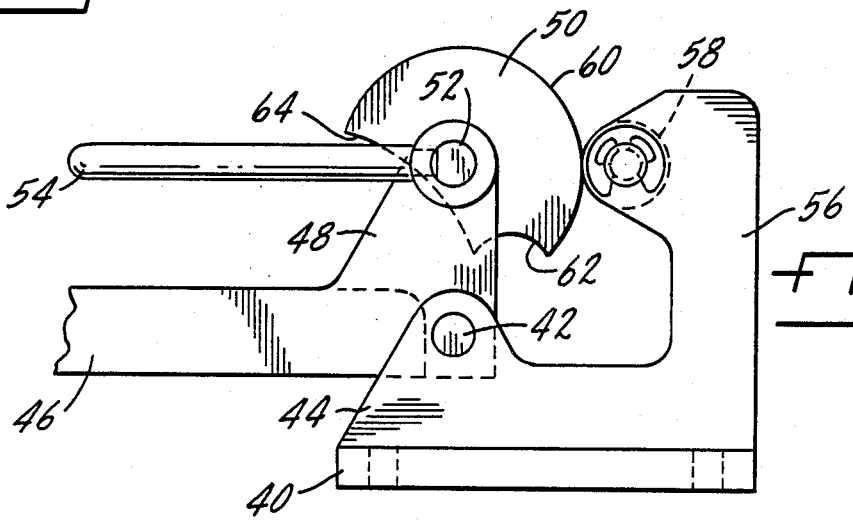
FIG. 7 is the same as FIG. 5 but of different operative position.
Figure 8:
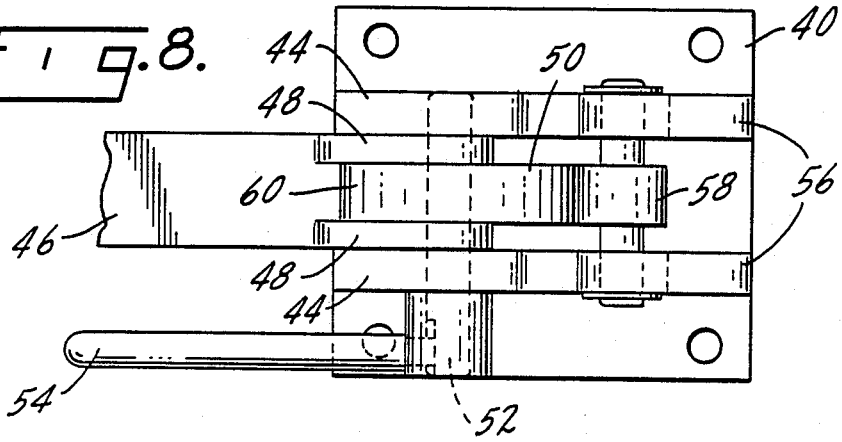
FIG. 8 is a top view of FIG. 7.

In FIG. 5 the roller 58 is in the detent 62 in the cam face and the clamp bar will be held in a substantially upright position there shown. This is the up-lock position which may be released by moving the clamp bar 46 clockwise a little after the cam handle 54 has been rotated counter-clockwise about 15° until the roller 58 is released from the detent 62. When the roller is released, the cam handle 54 is lifted so that the relief 64 clears the roller and the clamp bar is then rotated counterclockwise to a release position. The clamp bar 46 will then be brought down to its more or less horizontal position as in FIG. 7 and clamped against a work piece by rotating the cam handle 54 counterclockwise so that the cam surface would engage roller 58 and lock up the clamp against the work piece. To release, the operation would be reversed. The cam bar 54 would be rotated clockwise, from the FIG. 7 position and then to position 6 where the relief 64 would be opposite the roller which would cause the work piece to be released so that the clamp bar 46 may be raised to the vertical and up-lock position where the cut out or detent 62 engages the roller 58.

While the flanges of the base have been shown in a horizontal position, it should be understood that it can be vertically oriented and the unit will operate either vertically or horizontally.

A security locking device could also be added to the cam to keep it from rotating by accident which could inadvertently release the clamping pressure on the clamp bar or could release the clamp bar from its uplock position.

The unit has the additional advantage that parts of varying thicknesses can be clamped and held in position without adjustment to the clamping device.

While the preferred form has been shown and described and several variations have been suggested, it should be understood that suitable modifications, substitutions, alterations, and changes may be made without departing from the invention's fundamental theme.

The embodiments of the invention in which an exclusive property or privilege is claimed are defined as follows:

1. In a manually operated clamp, a base, a clamp bar pivotally mounted on the base, a pivotally mounted handle bar and cam unit with a cam and handle bar, a roller follower unit, one of the units being pivotally mounted on the base in spaced relation to the clamp bar pivot, the other unit being mounted to rotate with the clamp bar and positioned eccentric to the pivot of the clamp bar, a cut out in the face of the cam opposite the roller conforming generally to the exterior of the roller and adapted to engage the roller when the handle bar is in its release position to hold the clamp bar in a raised inoperative position, and a clearance on the face of the cam adjacent the cut out that will clear the roller when disposed opposite it so that when the roller is released from the cut out, the cam bar can be pivoted to its clamping position and the handle bar may be operated to bring the cam into engagement with the roller to lock the cam bar in place.

2. The structure of claim 1 further characterized in that a handle bar and cam unit are mounted on the base in spaced relation to the pivot of the clamp bar.

3. The structure of claim 1 further characterized in that the handle bar and cam unit are mounted to rotate with the clamp bar and are positioned eccentric to the pivot of the clamp bar.

4. The structure of claim 1 further characterized in that the follower roller unit is pivotally mounted on the base in spaced relationship to the clamp bar pivot.

5. The structure of claim 1 further characterized in that the follower roller unit is rotatably mounted on the clamp bar unit and positioned eccentric to the pivot of the clamp bar unit.

6. The structure of claim 1 further characterized in that the handle bar is socketed into the face of the cam.

7. The structure of claim 1 further characterized in that the handle bar is mounted on the pivot of the cam.

* * * * *